US005207565A

United States Patent [19]

Roessler

[11] Patent Number: 5,207,565

[45] Date of Patent: May 4, 1993

[54] VARIABLE GEOMETRY TURBOCHARGER WITH HIGH TEMPERATURE INSERT IN TURBINE THROAT

[75] Inventor: Manfred Roessler, Manhattan Beach, Calif.

[73] Assignee: AlliedSignal Inc., Morristown, N.J.

[21] Appl. No.: 838,636

[22] Filed: Feb. 18, 1992

[51] Int. Cl.[5] ..... F04B 17/00

[52] U.S. Cl. ..... 417/407; 415/202

[58] Field of Search ..... 417/406, 407, 405, 408, 417/409; 415/202, 163, 164

[56] References Cited

U.S. PATENT DOCUMENTS

| | | | |
|---|---|---|---|
| 3,033,519 | 5/1962 | Radtke | 415/163 |
| 4,097,188 | 6/1978 | Forster | 415/202 |
| 4,147,467 | 4/1979 | Leicht et al. | 417/407 |
| 4,300,869 | 11/1981 | Swearingen | 415/164 |
| 4,521,155 | 6/1985 | Osburn | 417/406 |
| 4,659,295 | 4/1987 | Burdette et al. | 417/407 |
| 4,676,717 | 6/1987 | Willyard, Jr. et al. | 417/407 |

*Primary Examiner*—Richard A. Bertsch
*Assistant Examiner*—Timothy S. Thorpe
*Attorney, Agent, or Firm*—Ken C. Decker; William N. Antonis

[57] ABSTRACT

A turbocharger includes a turbine housing with a variable geometry mechanism which controls the flow area of the throat through which motive exhaust gasses are communicated to the turbine wheel. The turbine housing is provided with an insert which defines one wall of the throat and which is cast in place as part of the turbine housing. The insert may be made of a relative expensive, high nickel content material to assure that a non-corrosive surface is provided adjacent to the vanes which are pivotally actuated to vary the area of the throat. The remainder of the housing is made of a standard ductile iron which is substantially less expensive than the more expensive corrosive resistant high nickel content material from which the insert is manufactured.

9 Claims, 2 Drawing Sheets

VARIABLE GEOMETRY TURBOCHARGER WITH HIGH TEMPERATURE INSERT IN TURBINE THROAT

This invention relates to a turbocharger.

Turbochargers use the exhaust gasses discharged from internal combustion engine as a motive gas to rotate a turbine wheel which is mounted on one end of a shaft. A compressor wheel is mounted on the other end of the shaft, and is turned by the turbine wheel to compress air, which is then communicated to the engine, thereby supplying charge air to the engine for increasing engine performance. To improve operating efficiency and to extend range, it is desirable to control the flow of motive exhaust gasses into the turbine wheel. This can be done by providing a series of pivotally mounted, circumferentially spaced vanes in the entrance throat to the turbine wheel. By pivoting the vanes, the nozzle area into the turbine wheel can be changed, thereby adjusting the flow of exhaust gasses into the turbine wheel.

A turbocharger having a variable nozzle area control of this type is disclosed in U.S. Pat. No. 4,659,295. In this device, a small pin is secured to one side of each of the vanes, and extends through one wall of the entrance throat to the turbine wheel. In this way, the angular orientation of the vanes can be changed by operation of an appropriate actuator, so that the nozzle area defined between the vanes can be adjusted. The other edge of each vane is closely adjacent the other wall of the entrance throat. Accordingly, since the motive exhaust gasses are extremely corrosive, the walls of the entrance throat must be of a material which is highly corrosive resistant, in order that the vanes do not stick or bind. The nozzle ring, upon which the vanes are mounted, is a separate member, and thus can be made of a corrosive resistant material. However, the common prior art practice is to make the entire turbine housing of a corrosive resistant material, to prevent sticking and binding of the nozzles against the opposite wall of the entrance throat. Of course, corrosive resistance materials are much more expensive than normal materials, so that the cost of a variable or adjustable turbocharger of this type is high.

According to the present invention, a relatively small, circumferentially extending insert circumscribes the entrance throat into the turbine wheel, and includes a face which defines with the other wall of the throat. The bulk of the turbine housing is made from a common ductile iron material. Since the insert is relatively small, substantial savings result by making only the insert out of the expensive, corrosive resistant material.

This and other advantages of the present invention will become apparent from the following description, with reference to the accompanying drawings, in which.

Figure 1:
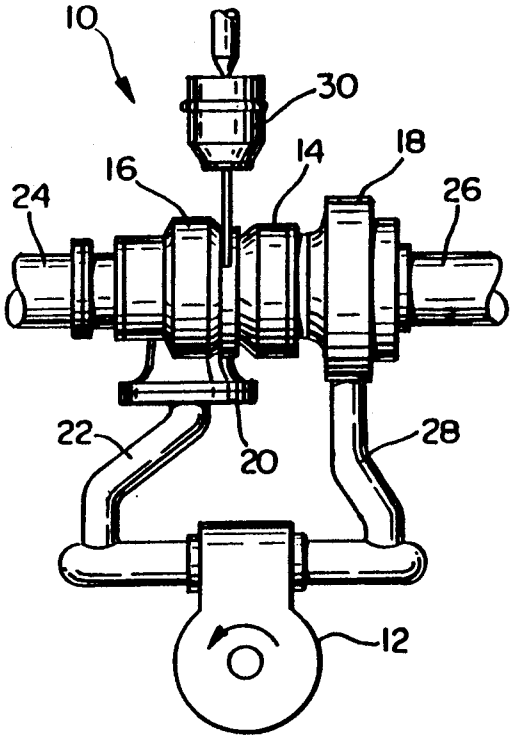
FIG. 1 is a diagrammatic illustration of a turbocharged engine system.

Referring now to FIG. 1 of the drawings, a turbocharger 10 supplies charge air to an engine 12 to increase the power output thereof. Turbocharger 10 includes a center housing 14, a turbine housing 16 mounted on one end of the center housing 14, and a compressor housing 18 mounted on the opposite end of the center housing 14. Exhaust gasses discharged by the engine 12 are communicated to the inlet 20 of turbine housing 16 through exhaust line 22 and are discharged from the turbine housing 16 into exhaust pipe 24. Air is drawn into the compressor housing 18 through inlet line 26 and is discharged to the engine 12 through line 28, thus providing charge air to the engine. A pneumatic actuator 30 is provided to control a variable geometry mechanism within the turbine housing 16 as will hereinafter be explained.

Figure 2:
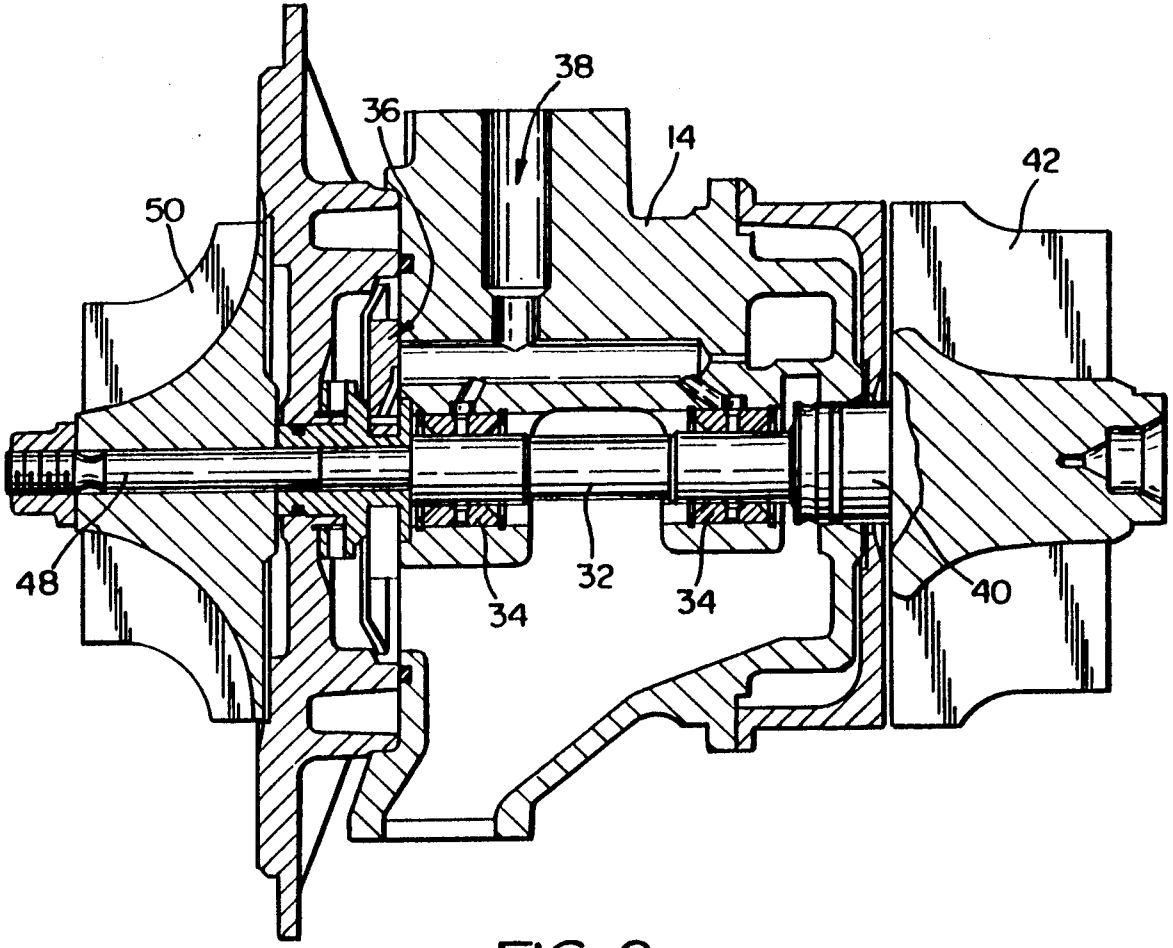
FIG. 2 is a cross section view of the internal components of an exhaust gas driven turbocharger.
Figure 4:
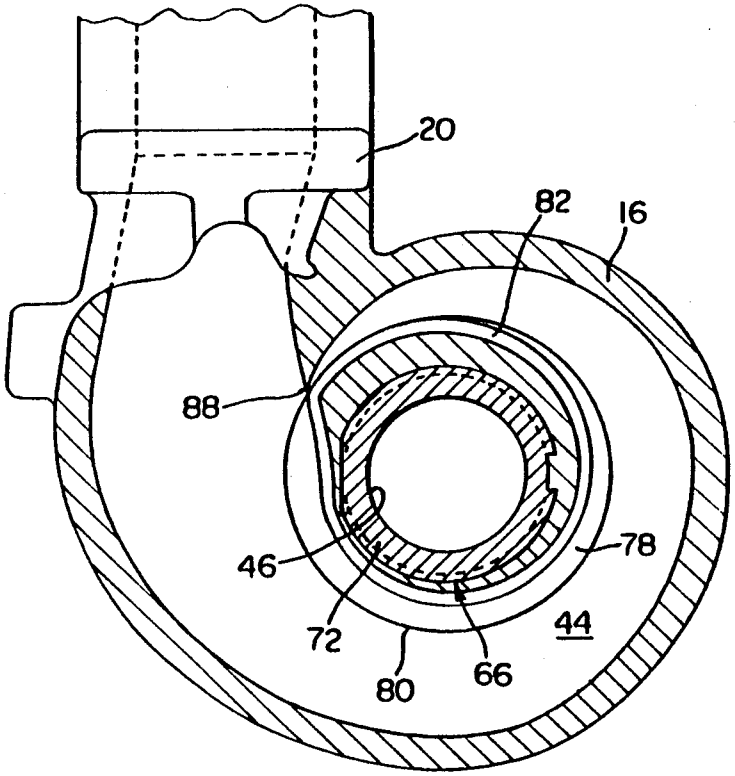
FIG. 4 is a cross-sectional view taken substantially along lines 4—4 of FIG. 3.

Referring now to FIG. 2, the internal components of turbocharger 10 include a shaft 32 which is rotatably supported within the center housing 14 by conventional journal bearings 34. Axial movement of the shaft 32 is controlled by conventional thrust bearing assembly 36. Lubricating oil is supplied to the bearings 34, 36 by oil passages generally indicated by the numeral 38. One end 40 of the shaft 32 extends into the turbine housing 16. A turbine wheel 42 is mounted on end 40 of the shaft 32 for rotation within the turbine housing 16. The exhaust gasses discharged by the engine 12 serve as motive gasses for turning the turbine wheel 42. Exhaust gasses received in the inlet 20 are discharged into a circumferentially extending volute 44 (FIGS. 3 and 4) which circumscribes the turbine wheel 42. After passing through the turbine wheel 42 and imparting rotation thereto, the exhaust gasses are discharged into exhaust pipe 24 through outlet 46. The other end 48 of the shaft 32 extends into the compressor housing 18. A compressor wheel 50 is mounted on end 48 of shaft 32 for rotation with the shaft 32. Rotation imparted to the shaft 32 by the turbine wheel 42 rotates the compressor wheel 50, thereby drawing in air through the inlet 26 and increasing the pressure air as it passes through the turbine wheel 50. The pressurized air is then discharged into the line 28 for supplying charge air to the engine 12.

As discussed above, it is desirable to control the flow of exhaust gasses from the volute 44 into the turbine wheel 42 in order to improve the performance and/or to extend the operating range of the turbocharger 10. Accordingly, circumferentially spaced, pivotally mounted motive gas control vanes generally indicated by the numeral 52 are provided around the circumferentially extending throat 54 which circumscribes the turbine wheel 42 and through which motive exhaust gasses are communicated from the volute 44 into the turbine wheel 42. Each of the vanes 52 is mounted on an axially extending pivot pin 56 which is supported within a nozzle ring 58. The angular position of the vanes 52, only one of them being shown in FIG. 3 of the drawing, is controlled by an actuating mechanism generally indicated by the numeral 60. The details of the vanes 52 and the actuating mechanism 60 are disclosed in the aforementioned U.S. Pat. No. 4,659,295 and, since they form no part of the present invention, will not be disclosed in detail herein. The actuating mechanism 60 includes a crank arm 62 which is actuated by the pneumatic actuator 30 to thereby control the angular position of the vanes 52. Control of the angle of the vanes 52 will increase or decrease the nozzle area of the throat area 54, thereby controlling the flow of motive exhaust gasses through the throat 54 and into the turbine wheel 52.

As can be readily appreciated by those skilled in the art, in order to effectively control the flow of motive gasses through the throat 54, the clearance between the vanes 52 and the walls of the throat 54 must be carefully controlled. The spacing of the throat 54 is controlled by circumferentially spaced spacing pins 64. As will also be readily appreciated, the motive exhaust gasses communicated through the throat 54 are at a very high temperature and are extremely corrosive. Accordingly, the nozzle ring 58 must be made of an extremely expensive corrosive resistant material, such as stainless steel. Also, since the other wall of the throat 54 is defined on turbine housing 16, it was also necessary to make the entire turbine housing in prior art turbochargers out of a very expensive high nickel content corrosive resistant material. This made the turbocharger assembly 10 extremely expensive. According to the invention, the bulk of the turbine housing 16 is made from a common, low cost material, such as ductile iron. The housing 16 is provided with a circumferentially extending, cast-in-place insert generally indicated by the numeral 66 which is coaxial with the turbine wheel 42 and which circumscribes the outlet 46.

Figure 3:
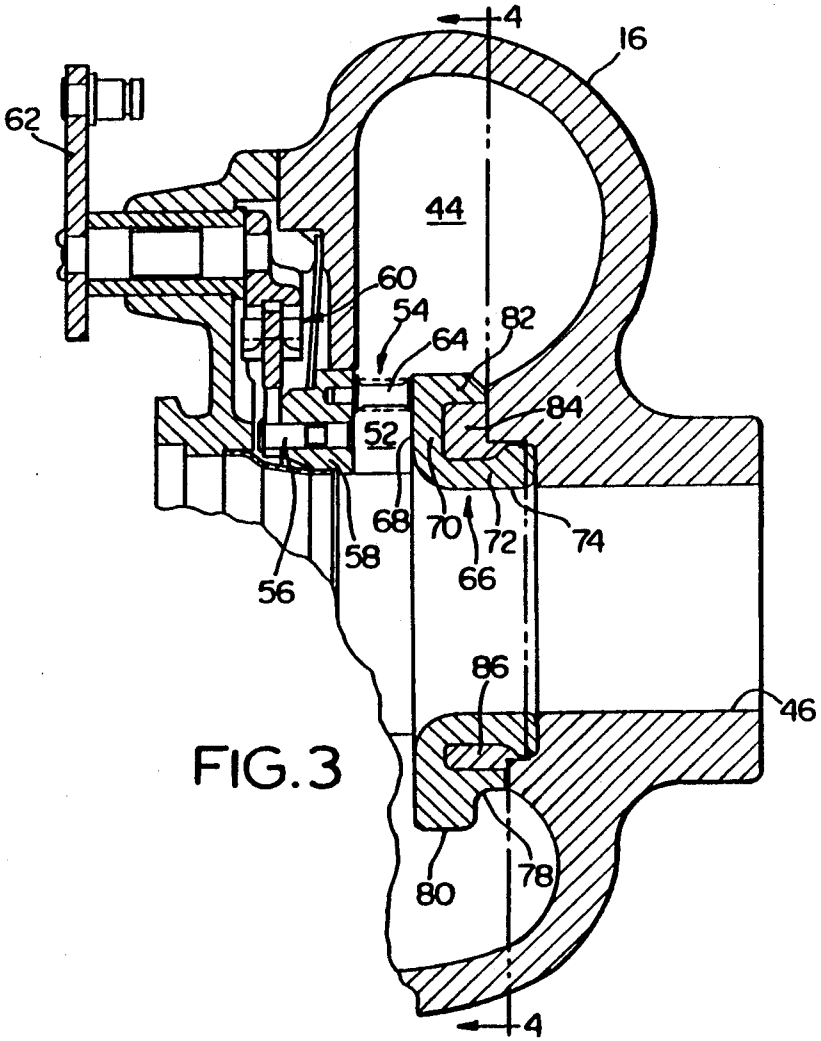
FIG. 3 is cross-sectional view of the turbine end of the turbocharger illustrated in FIGS. 1 and 2 with the turbine wheel removed.

The insert 66 is made from a relatively expensive, corrosion resistant material, such as D5B NI-RESIST, which has a very high nickel content as compared to standard ductile iron, which has no nickel content, G and therefore has enhanced corrosion resistance properties. The insert 66 is placed in the casting mold and the ductile iron poured around the insert to form a cast-in-place structure. The insert 66 includes a radially projecting surface 68, which defines the wall of the throat 54 opposite the wall defined by the nozzle ring 58. Radially projecting surface 68 is carried on radially extending portion 70 of the insert 66. A portion 72 of the insert 66 extends axially with respect to the axis about which the turbine wheel 42 rotates, and carries an axially extending surface 74 which defines a portion of the outer circumferential surface of the outlet opening 46. The insert 66 further includes a contoured surface 78 defining a portion of the contour of the volute 44, and further carries a circumferentially extending surface 80 which is at a substantially constant radius with respect to the periphery of the volute about the axis of the outlet opening 46. Accordingly, the surfaces 78, 80 are carried on a portion 82 of the insert 66, and the portions 70, 72, and 82 cooperate to define a circumferentially extending cavity 84. As can be seen in FIG. 3, a portion of the housing 16 made of the inexpensive material extends through the opening 86 and into the cavity 84, to thereby retain the insert 66 on the housing 16. It will be noted that the cross-sectional area of volute 44 decreases from a maximum area adjacent the inlet 20 to a minimum area where the tail of the volute reattaches to the housing, indicated generally at 88 on FIG. 4. Viewing FIG. 3, it will also be noted that the cross-sectional area of the cavity 84 also decreases as the cross-sectional area of the volute decreases. The area of the opening at the larger cross sectional area of the volute is sufficient to assure that sufficient material will flow into the cavity 84 and then to assure that the insert 66 is securely attached to the housing 16. Accordingly, in order to accommodate the shape of the volute as its cross-sectional area decreases, the surface 80 is at a substantially constant radius, and the portion 78 which defines a part of the contour of the volute will be at a non-constant radius from the axis of the opening 46.

I claim:

1. Turbocharger comprising a center housing, a compressor housing on one end of the center housing, a turbine housing on the other end of the center housing, a shaft rotatably mounted in said center housing, said shaft having a pair of ends, one end of the shaft extending into the compressor housing, a compressor wheel mounted on said one end of the shaft and within said compressor housing for rotation with the shaft, the other end of the shaft extending into the turbine housing, a turbine wheel mounted on said other end of the shaft within the turbine housing for rotation with the shaft, said turbine housing including a circumferentially extending volute for carrying motive gasses to said turbine wheel, said volute extending around said turbine wheel, a pair of walls extending circumferentially and spaced apart axially with respect to said shaft and defining a circumferentially extending throat for communicating the volute with the turbine wheel, a set of circumferentially spaced vanes within said throat and pivotally mounted on one of said walls for regulating flow of motive gasses into said turbine wheel, and a circumferentially extending insert carried by said turbine housing and having a portion defining the other wall, said insert being made of a material having enhanced corrosion resistant properties as compared to the material from which the turbine housing is made, said insert defining a circumferentially extending cavity within said insert, said cavity having an opening, said turbine housing extending through said opening into said cavity to thereby retain said insert on the turbine housing.

2. Turbocharger as claimed in claim 1, wherein a circumferentially extending cavity is defined within said insert, said cavity having an opening, said turbine housing extending through said opening into said cavity to thereby retain said insert on the turbine housing.

3. Turbocharger as claimed in claim 2, wherein said volute decreases from a maximum cross-sectional area at the inlet of the volute to a minimum cross-sectional area, the cross-sectional area of said cavity decreasing around the circumference thereof from a maximum cross-sectional area at the maximum cross-sectional area of the volute.

4. Turbocharger as claimed in claim 1, wherein said turbine housing defines an outlet extending axially with respect to the shaft and having a circumferentially extending wall, said insert including a circumferentially extending section projecting from the portion of the insert defining said wall and defining a portion of the wall of the outlet.

5. Turbocharger as claimed in claim 4, wherein said insert further includes a generally axially projecting surface that defines a portion of the contour of the volute.

6. Turbocharger as claimed in claim 5, wherein said cavity is defined by said portion, said circumferentially extending section, and said generally axially projecting surface.

7. Turbocharger as claimed in claim 1, wherein said insert further includes a generally axially projecting surface that defines a portion of the contour of the volute.

8. Turbocharger as claimed in claim 7, wherein said generally axially projecting surface extends circumferentially around said shaft and includes a first portion at a substantially constant radius from said shaft.

9. Turbocharger as claimed in claim 8, wherein said generally axially projecting surface includes a second portion which a portion of the contour of said volute and which is disposed at a nonconstant radius from said shaft.

* * * * *